US005224811A

United States Patent [19]

Sigrist et al.

[11] Patent Number: 5,224,811

[45] Date of Patent: Jul. 6, 1993

[54] RESTRAINING DEVICE FOR A HOPPER

[75] Inventors: Albert Sigrist, Colombier; Roberto Rizzolo, Champ-du-Moulin, both of Switzerland

[73] Assignee: Fabriques de Tabac Reunies, S.A., Neuchatel, Switzerland

[21] Appl. No.: 649,912

[22] Filed: Feb. 1, 1991

[30] Foreign Application Priority Data

Feb. 20, 1990 [CH] Switzerland ..... 546/90

[51] Int. Cl.[5] ..... B07C 5/00

[52] U.S. Cl. ..... 414/289; 221/264; 209/535; 209/536; 414/288; 901/47

[58] Field of Search ..... 414/288, 289, 287, 293, 414/787, 294, 287, 403, 414, 754, 745.8; 221/264, 175; 198/533, 373, 750, 752; 209/921, 396, 535, 536, 82; 53/151, 54, 507, 148, 52, 150, 49, 498, 493, 544; 901/47

[56] References Cited

U.S. PATENT DOCUMENTS

| | | | |
|---|---|---|---|
| 3,501,052 | 3/1970 | Rudszinat | 221/175 |
| 3,785,487 | 1/1974 | Spencer | 209/82 |
| 4,174,780 | 11/1979 | Farrar et al. | 209/536 |
| 4,648,232 | 3/1987 | Brinker et al. | 209/535 X |
| 4,953,711 | 9/1990 | Focke | 209/535 |
| 4,962,629 | 10/1990 | Focke | 209/536 X |

FOREIGN PATENT DOCUMENTS

| | | | |
|---|---|---|---|
| 0241789 | 10/1987 | European Pat. Off. . | |
| 64046 | 8/1891 | Fed. Rep. of Germany | 414/288 |
| 258617 | 2/1987 | France . | |

*Primary Examiner*—Frank E. Werner
*Attorney, Agent, or Firm*—Jeffrey H. Ingerman

[57] ABSTRACT

Cigarettes are restrained by arresting a cigarette oriented askew relative to the other cigarettes flowing into a hopper before that cigarette blocks the distribution channels of the hopper, thus stopping the manufacturing process. An arrested cigarette is furthermore detected. The hopper equipped with the restraining device, particularly a hopper for distributing cigarettes, contains a set of gratings (2) halfway up it, made up of a fixed grating (20) above which there is a movable grating (21) actuated with a translatory reciprocating movement. The set of gratings can restrain any cigarette (13A) presented and traveling crosswise in the hopper before this cigarette can go on to interrupt the flow through distribution channels (15) at the outlet of the hopper. A detection device (3) comprising in particular a photoelectric cell (31) and a light source (30) detects a space (13B) void of cigarettes, caused by the crooked cigarette restrained by the set of gratings, and transmits an alarm. It is thus possible for an operator to intervene in order to withdraw the crooked cigarette without affecting the operation of the installations situated downstream from the hopper. A hopper provided with such a device may also be used for an automatic machine-tool feeder.

13 Claims, 5 Drawing Sheets

Figure 1:
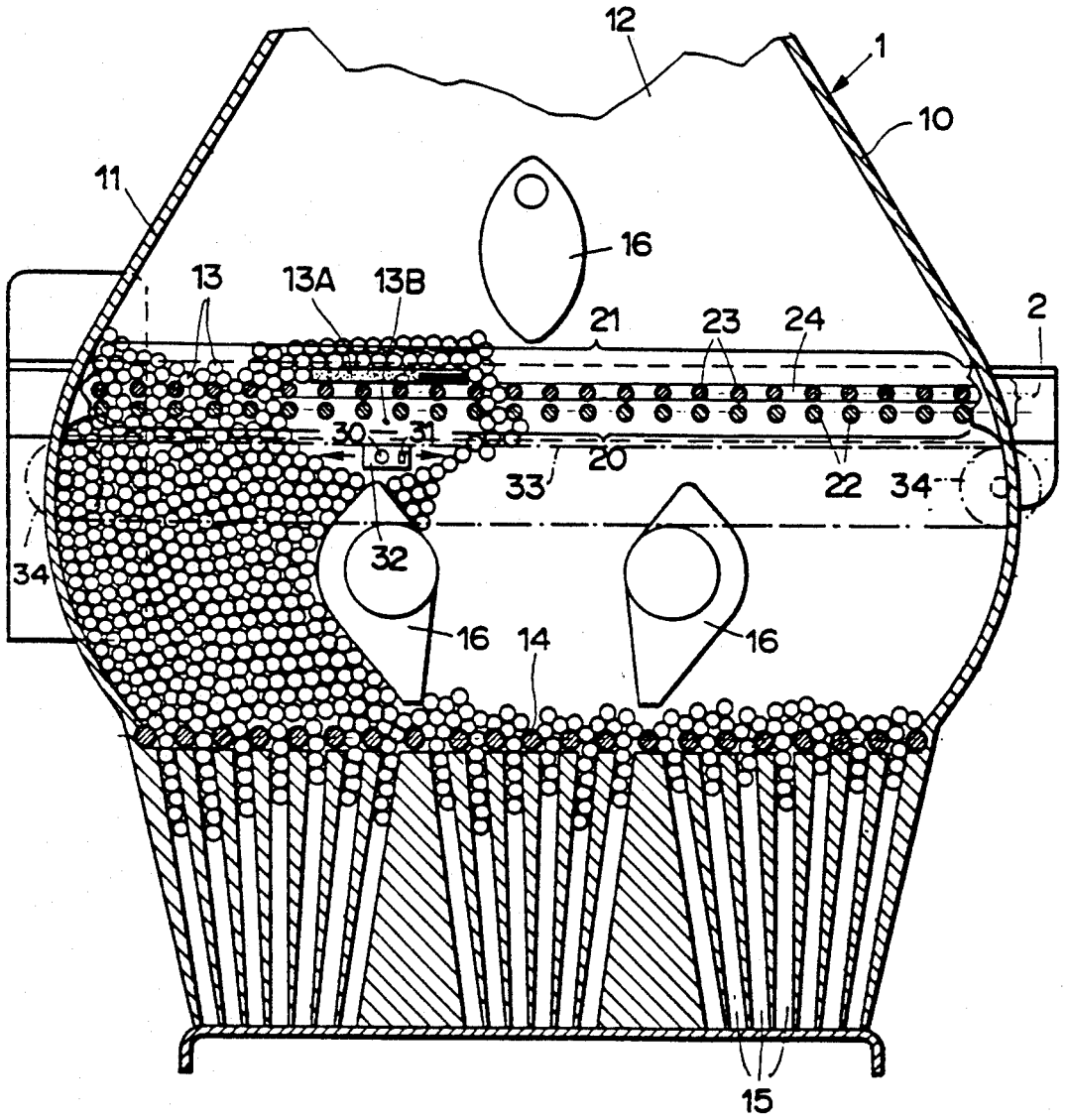

FIG. 2A
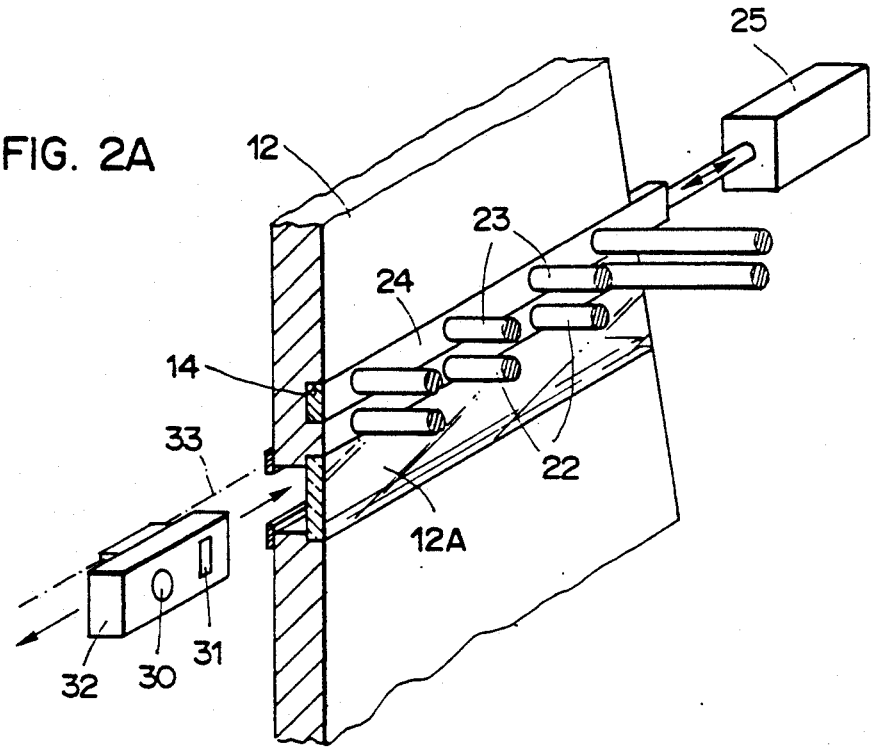
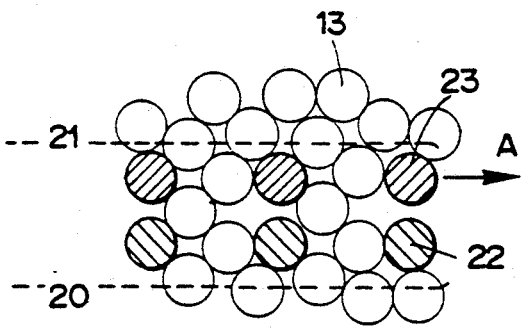
FIG. 3A
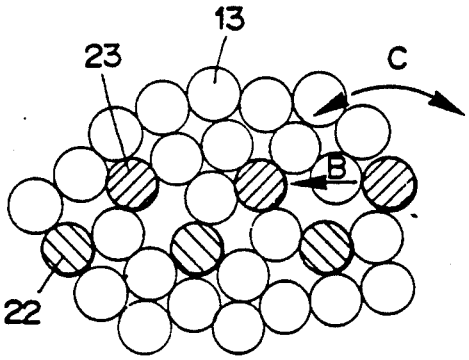
FIG. 3B

FIG. 4A
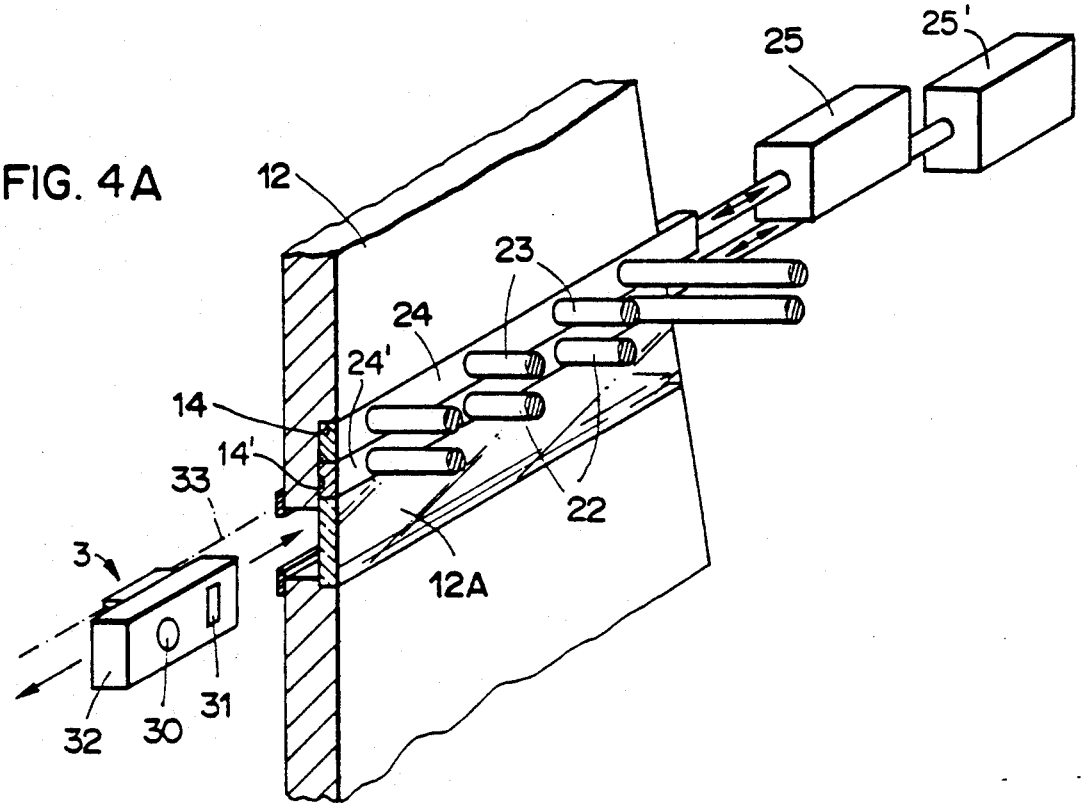
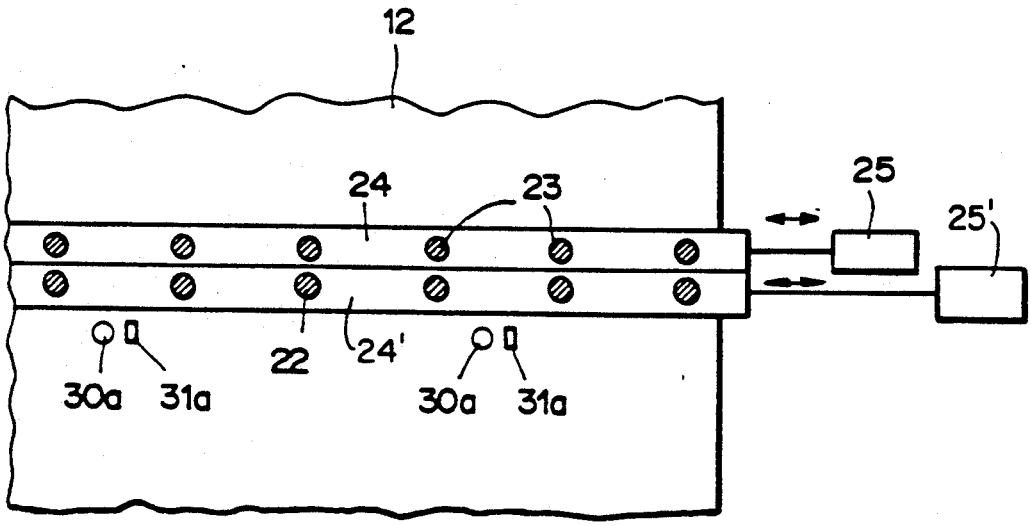
FIG. 4B

RESTRAINING DEVICE FOR A HOPPER

This invention relates to the feeding of articles to a hopper, and more particularly to a device of the type intended for restraining cylindrical elements disposed askew relative to a flow of cylindrical elements disposed side by side and parallel to one another. The invention further relates to a method of restraining cylindrical elements by means of the aforementioned device.

During the manufacture of cigarettes, particularly when they are being prepared for packaging, the cigarettes reach a hopper which first forms a buffer stock and then distributes them through suitable channels to the packaging mechanism. When the cigarettes are being conveyed toward the hopper, they are all disposed parallel to one another and oriented in the same direction, i.e., when they have a filter-tip at one end, all the filter-tips are on the same side. In order for this arrangement to be maintained within the hopper, the latter will have a depth slightly greater than the length of the cigarettes so that they can move without rubbing too much against the hopper walls.

It sometimes happens, however, that while the cigarettes are being conveyed to the hopper, one of them turns crosswise, i.e., in a direction more or less perpendicular to that of the rest of the cigarettes, and travels thus into the hopper until it arrives close to the mouth of one or more of the distribution channels, which it blocks since it is not in a proper position to enter. This leads to an interruption of the flow into the respective distribution channels, hence to a significant drop in the output of the installation as a whole. One possible remedy consists in having an operator continuously supervise the proper flow of cigarettes into the hopper and intervene before an incorrectly oriented cigarette can disrupt the output of the hopper.

Another possibility is described in U.S. Pat. No. 4,174,780, which shows a cigarette-distributing hopper comprising means for restraining improperly oriented cigarettes made up of a first grating, or "ladder," placed toward the top of the hopper, restraining cigarettes disposed the wrong way, and a plurality of channels placed toward the bottom of the hopper and restraining cigarettes turned longitudinally. One drawback of the device described is that the restraining means are composed of two distinct parts and that only the second of these parts is provided with means for detecting an incorrectly oriented cigarette. Thus, supervision by the operator is still necessary in order to eliminate an improperly oriented cigarette restrained by the upper grating.

It is an object of this invention to provide an improved device for restraining cylindrical objects in a hopper, as well as a method for utilizing this device, whereby the aforementioned drawbacks of prior art devices may be overcome.

To this end, the restraining device according to the present invention, of the type initially mentioned, comprises restraining means made up of a plurality of superimposed gratings composed of elements of rods of circular cross-section and of a diameter equal to the diameter of one of the cylindrical elements, spaced from one another by a spacing pitch greater than the diameter of one of the cylindrical elements and less than double the diameter of one of the cylindrical elements, placed parallel to the freely flowing cylindrical elements, the gratings being disposed transversely to the flow of cylindrical elements, and at least one of them being animated with a translatory alternating movement, the amplitude of which equals half a spacing pitch in one direction and half a spacing pitch in the other direction, and further comprising detection means made up of photoelectric-cell means and light-source means, disposed under the lower grating and capable of detecting an interruption of the flow of the cylindrical elements.

In the method of restraining cylindrical elements by means of the foregoing device, the restraining means made up of a plurality of superimposed gratings, at least one of these gratings being animated with a translatory alternating movement, are provided in order that restraining may take place upstream from a location where the cylindrical elements disposed askew would obstruct at least one canalization leading the elements to a further stage of the manufacturing process, and a cylindrical element askew, restrained by the restraining means, creates beneath itself, in the direction of flow, a space empty of cylindrical elements, this empty space being detected by the detection means.

Possible applications of the foregoing device in various embodiments and modifications, and of the method for utilizing it, are in relation to a cigarette-distributing hopper or to a hopper for distributing parts for an automatic machine-tool.

Figure 2B:
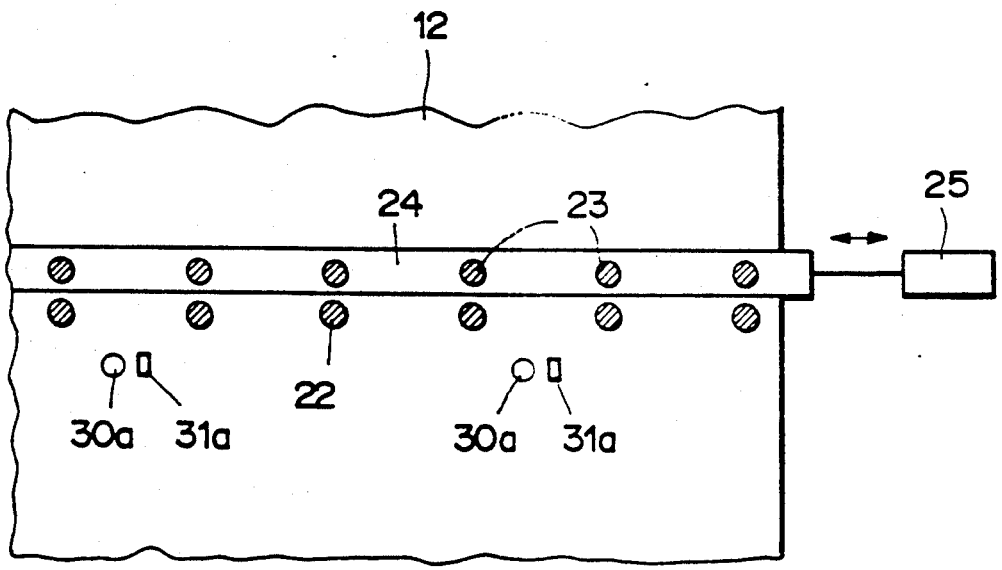
Figure 5A:
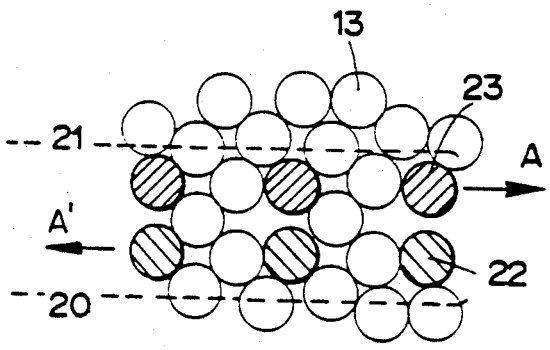
Figure 5B:
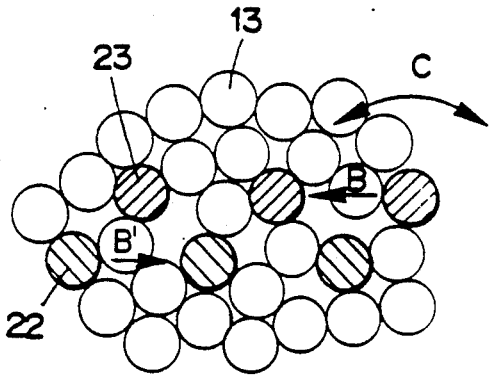

A preferred embodiment of the invention will now be described in detail with reference to the accompanying drawings, in which:

FIG. 1 is a vertical section through a cigarette-distributing hopper provided with a device according to the invention, FIG. 2A is perspective views of part of the rear portion of the hopper, FIG. 2B is an elevational view of the part of the rear portion of the hopper seen in FIG. 2A, FIGS. 3A and 3B are diagrams illustrating the alternating displacement movement of a second grating relative to a first grating and the resultant movement of the cigarettes, FIGS. 4A and 4B are views, similar to FIGS. 2A and 2B, of an alternative embodiment of part of the rear portion of the hopper, and FIGS. 5A and 5B are diagrams illustrating alternating displacement movement of both gratings relative to each other and the resultant movement of the cigarettes.

The same drawing figures and the same description thereof below serve just as well to describe an embodiment of the invention adapted to a hopper for distributing parts intended for an automatic machine-tool.

A hopper 1 shown in FIG. 1 comprises two sidewalls 10 and 11, the shape of which is adapted to permit a proper flow of the cigarettes, as well as a rear wall 12 and a cover wall (not shown) facing rear wall 12 and spaced therefrom by a distance slightly greater than the length of a cigarette. The volume of hopper 1 is primarily determined by the size and shape of sidewalls 10 and 11 inasmuch as rear wall 12 and the cover wall are spaced at a constant distance. Cigarettes 13 are brought to hopper 1 by any suitable means (not shown) and discharged into it at the top; as shown in the drawing, cigarettes 13 are, in principle, all oriented in the same direction, i.e., disposed end on, between rear wall 12 and the cover wall. After they have passed into hopper 1, a distribution grating 14 separates the compact flow of cigarettes into numerous streams where the cigarettes advance one behind the other into distribution channels 15 in order to be conveyed to the following operation, which may be a packaging operation (not shown). Baffles 16 of appropriate shape are actuated with a slow, reciprocating rotational movement to keep bridges from forming within hopper 1, obstructing the flow of cigarettes. If, for one reason or another, a cigarette 13A were askew in relation to the others, it could move down to distribution grating 14 and block it, interrupting the flow in one or more of the distribution channels 15. In order to prevent this, hopper 1 is provided with the inventive restraining device, viz., a set of gratings 2, composed of a first, fixed grating 20 and, situated above it, a second, movable grating 21; these two gratings are disposed horizontally well before distribution channels 15, i.e., about halfway up hopper 1, and extend over the entire passage width of hopper 1, i.e., between sidewalls 10 and 11. Fixed grating 20 is composed of rod elements 22 disposed side by side, parallel to the general orientation of the cigarettes, and suitably secured, at least to rear wall 12, by welding or screws. Rod elements 23 of movable grating 21 are disposed in the same way as those of fixed grating 20 except that they are secured at one end to a slide 24 sliding horizontally above fixed grating 20 in a manner to be explained below.

The way in which movable grating 21 is moved may be seen in FIG. 2A, where this grating is represented by four of its rod elements 23 secured in any suitable manner, e.g., by welding or screws, to slide 24 which runs in a groove 14 made in rear wall 12, slide 24 being driven reciprocatingly by drive means 25 which may be of any kind and need therefore not be described in detail. In an alternative embodiment shown in FIG. 4A, rod elements 22 are also mounted on a movable slide 24', running in a groove 14' in rear wall 12. Slide 24' may be driven reciprocatingly by drive means 25' similar to drive means 25, and preferably is driven in opposition to the motion of slide 24. Reverting to FIG. 1, it may be seen how grating system 2 operations when a cigarette 13A is askew; in that case, it will remain blocked against movable grating 21, hindering the normal passage of the cigarettes through the spaces in movable grating 21 and fixed grating 20 which it overhangs. The result will be a space 13B void of cigarettes. Detection means 3, disposed behind a transparent portion 12A (see FIGS. 2A and 4A) of rear wall 12 and comprising, in this preferred embodiment, a light source 30 and a photoelectric cell 31 mounted side by side on a support 32 fixed to an endless belt 13 running over two pulleys 34, so that support 32, hence light source 30 and photoelectric cell 31, move linearly from one sidewall 10 to the other 11 and vice versa, beneath fixed grating 20, together with belt 33 driven reciprocatingly by means of pulleys 34, one of these being driven rotatingly for a certain number of revolutions in one direction, then in the opposite direction, by conventional drive means (not shown). When the light emitted by source 30 encounters ends of cigarettes, particularly ends provided with a filter tip, the whiteness of the latter reflects part of the emitted light toward cell 31, which then does not transmit any alarm signal; when, on the contrary, the light ray encounters a space 13B devoid of cigarettes, the ray is not reflected, cell 31 is no longer excited, and an alarm signal, e.g., an acoustic signal, is transmitted to the operator, who will then know that he must intervene by opening the cover wall to withdraw the crooked cigarette 13A in order to restore the proper flow of cigarettes.

FIGS. 2B and 4B illustrate a modification of detection means 3, which are then made up of a plurality of light sources 30A and of detectors 30B, disposed side by side, the distance between each source-and-detector pair being less than the length of a cigarette.

FIGS. 3A and 3B show the operating details of fixed grating 20 and movable grating 21. In FIG. 3A, movable grating 21, represented by only three of its rod elements 23, is in its intermediate position, i.e., exactly superimposed above fixed grating 20, which is likewise represented by three of its rod elements 22. Movable grating 21 is about to move, e.g., in the direction of arrow A, to attain the position shown in FIG. 3B, where each rod element 23 of movable grating 21 is situated halfway between two consecutive rod elements 22 of fixed grating 20. Thereafter, movable grating 21 will resume its travel, this time in the direction of arrow B, to attain the superimposed position shown in FIG. 3A, and will continue its travel to attain a position symmetrical with that shown in FIG. 3B, whence it will return in the direction of arrow A, and so on. In FIGS. 3A and 3B, the importance of the size and shape of rod elements 22 and 23 will be noted; during the translatory motion of movable grating 21 over fixed grating 20, the cigarettes situated between rod elements 22 and 23 must roll around those elements without being damaged by any sharp edges, which is why rod elements 22 and 23 are preferably rounded. Although a generally oval shape or a vane-shape may be acceptable for rod elements 22 and/or 23, the preferred shape chosen and depicted for this embodiment is a circular shape, having a diameter corresponding to that of a cigarette, so that the cigarettes roll easily around rod elements 23 during their displacement, as indicated by arrow C. On the other hand, the spacing interval between two consecutive rod elements of fixed grating 20 or movable grating 21 is between once and twice the diameter of a cigarette in order to allow only one cigarette at a time to pass easily through grating system 2.

FIGS. 5A and 5B show the operating details of the embodiment of FIGS. 4A and 4B in which both gratings 20, 21 are movable. The operation is similar to that described in connection with FIGS. 3A and 3B, except that when grating 21 is moving in direction A, grating 20 is also moving, preferably in opposing direction A', and when grating 21 is moving in direction B, grating 20 is moving, preferably in direction B'.

Although a preferred form of detection means 3 has been described, it will be understood that other forms are possible; in particular, if the amount of light reflected by the ends of the cigarettes would be insufficient to excite the cell, e.g., in the case of cigarettes without filters, it would be easy to dispose a reflecting tape on the inner surface of the wall opposite the one behind which the cell is situated, the light ray being reflected only when it passes through a space 13B void of cigarettes, thus exciting the cell which gives the alarm. Other modifications may also be proposed, e.g., replacing the aforementioned reflecting tape by an elongated light source disposed on the cover wall and occupying the entire width of the hopper; as in the previous instance, the cell will be excited and will transmit the alarm only when it detects a light ray passing through a space void of cigarettes.

In another embodiment, the rear wall may be provided with a plurality of photoelectric cells aligned under the fixed grating, each cell being spaced from the next one by a distance less than one cigarette-length, and the cover wall being provided, as in the preceding instance, with an elongated light source; in this case, one or two of the cells are excited when a light ray passes through a space void of cigarettes. In this embodiment, it is possible to eliminate the belt-and-pulley arrangement.

In all embodiments, it is necessary to provide for a time-lag between the moment when the photoelectric cell detects an empty space and the moment when the alarm is transmitted so that the small interstices normally existing between round objects such as cigarettes do not set off an untimely alarm.

Grating device 2 has been described and illustrated in FIG. 1 as arresting a cigarette which is askew, but disposed horizontally; in the case of a cigarette presented obliquely relative to the horizontal plane of gratings 20 and 21, this cigarette would be brought little by little into a reclining position owing to the motion of movable grating 21 and the weight of the cigarettes above it. In the case of a cigarette presented vertically above movable grating 21, it will be seen in FIG. 3B that the space remaining between rod elements 23 of movable grating 21 and rod elements 22 of fixed grating 20 does not leave enough room for an element of the diameter of a cigarette to pass; as in the preceding case, therefore, the cigarette in question will either be returned to a horizontal position or else be bent and obstruct the passage, creating a space empty of cigarettes below it, as has been seen previously.

Thus it is apparent that the inventive device and method are quite capable of restraining any cylindrical object, e.g., any cigarette, which is not correctly oriented in the hopper and of reporting this incident, without affecting the running of the installations situated downstream from the hopper and, consequently, without decreasing the output of the installation, and this without its being necessary for an operator to observe continuously the proper progress of the flow in the hopper. Although this device and method have been described as applied to a stage of cigarette manufacture, it will be understood that it may apply just as well to the manufacture of other objects of a generally cylindrical shape which have to be aligned at some point in their process of manufacture; for example, apparatus for feeding long, thin parts to an automatic machine-tool may equally well be equipped with this device, which will report a part disposed askew without interruption of the rate of production.

What is claimed is:

1. A device for restraining cylindrical elements disposed askew relative to a flow of cylindrical elements disposed side by side and parallel to one another, each of said cylindrical elements having a diameter, wherein the improvement comprises:

means for providing said flow of cylindrical elements;

restraining means downstream from said flow-providing means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction;

detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements.

2. The device of claim 1, wherein:

said restraining means comprises two said gratings and said actuating means is adapted to move each of said two gratings with a said alternating translatory motion in opposition to the motion of the other of said gratings; and said photoelectric-cell means comprises a single photoelectric cell, and further comprises displacement means for moving said single photoelectric cell with a translatory motion over the entire width of said restraining means.

3. The device of claim 1, wherein;

said restraining means comprises two said gratings, a first one of said gratings being fixed and a second one of said gratings being movable by said actuating means and situated upstream from said first one of said gratings relative to the flow of cylindrical element; and said photoelectric-cell means comprises a single photoelectric cell, and further comprises displacement means for moving said single photoelectric cell with a translatory motion over the entire width of said restraining means.

4. The device of claim 1, wherein:

said restraining means comprises two said gratings and said actuating means is adapted to move each of said two gratings with a said alternating translatory motion in opposition to the motion of the other of said gratings; and said photoelectric-cell means comprises a plurality of photoelectric cells spaced at intervals shorter than the length of one of the cylindrical elements and disposed in a plane parallel to the planes of said gratings.

5. The device of claim 1, wherein;

said restraining means comprises two said gratings, a first one of said gratings being fixed and a second one of said gratings being movable by said actuating means and situated upstream from said first one of said gratings relative to the flow of cylindrical elements; and said photoelectric-cell means comprises a plurality of photoelectric cells spaced at intervals shorter than the length of one of the cylindrical elements and disposed in a plane parallel to the planes of said gratings.

6. A cigarette-distributing hopper for distributing cylindrical elements having a diameter, said hopper comprising:

means for providing a flow of cylindrical elements;

restraining means downstream from said flow providing means disposed askew said flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction;

detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings, and said actuating mans are adapted to move each of said two gratings with a said alternating translatory motion in opposition to the motion of the other of said gratings; and said photoelectric-cell means comprises a single photoelectric cell, and further comprises displacement means for moving said single photoelectric cell with a translatory motion over the entire width of said restraining means.

7. A cigarette-distributing hopper for distributing cylindrical elements having a diameter, said hopper comprising:

means for providing a flow of cylindrical elements;

restraining means downstream from said flow providing means disposed askew said flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction;

detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings, a first one of said gratings being fixed and a second one of said gratings being movable by said actuating means and situated upstream from said first one of said gratings relative to the flow of cylindrical elements; and said photoelectric-cell means comprises a single photoelectric cell, and further comprises displacement means for moving said single photoelectric cell with a translatory motion over the entire width of said restraining means.

8. A cigarette-distributing hopper for distributing cylindrical elements having a diameter, said hopper comprising:

means for providing a flow of cylindrical elements;

restraining means downstream from said flow providing means disposed askew said flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction;

detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings and said actuating means is adapted to move each of said two gratings with a said alternating translatory motion in opposition to the motion of the other of said gratings; and said photoelectric-cell means comprises a plurality of photoelectric cells spaced at intervals shorter than the length of one of the cylindrical elements and disposed in a plane parallel to the planes of said gratings.

9. A cigarette-distributing hopper for distributing cylindrical elements having a diameter, said hopper comprising:

means for providing a flow of cylindrical elements;

restraining means downstream from said flow providing means disposed askew said flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction;

detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings, a first one of said gratings being fixed and a second one of said gratings being movable by said actuating means and situated upstream from said first one of said gratings relative to the flow of cylindrical elements; and said photoelectric-cell means comprises a plurality of photoelectric cells spaced at intervals shorter than the length of one of the cylindrical elements and disposed in a plane parallel to the planes of said gratings.

10. A hopper for distributing parts for an automatic machine tool, said parts being in a form of cylindrical elements each having a diameter, said hopper comprising:

means for providing a flow of cylindrical elements;

restraining means downstream from said flow providing means disposed askew a flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction; and detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings and said actuating means is adapted to move each of said two gratings with a said alternating translatory motion in opposition to the motion of the other of said gratings; and said photoelectric-cell means comprises a single photoelectric cell, and further comprises displacement means for moving said single photoelectric cell with a translatory motion over the entire width of said restraining means.

11. A hopper for distributing parts for an automatic machine tool, said parts being in the form of cylindrical elements each having a diameter, said hopper comprising:

means for providing a flow of cylindrical elements;

restraining means downstream from said flow providing means disposed askew a flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction; and detection means including photoelectric-cell means and light-source means, disposed immediately downstream of said gratings and capable of detecting an interruption of the flow of the cylindrical elements; and means downstream from said detection means for receiving said flow of elements; wherein:

said restraining means comprises two said gratings, a first one of said gratings being fixed and a second one of said gratings being movable by said actuating means and situated upstream from said first one of said gratings relative to the flow of cylindrical elements; and said photoelectric-cell means comprises a single photoelectric cell, and further comprises displacement means for moving said single photoelectric cell with a translatory motion over the entire width of said restraining means.

12. A hopper for distributing parts for an automatic machine tool, said parts being in a form of cylindrical elements each having a diameter, said hopper comprising:

means for providing a flow of cylindrical elements;

restraining means downstream from said flow providing means disposed askew a flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction; and detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings and said actuating means is adapted to move each of said two gratings with a said alternating translatory motion in opposition to the motion of the other of said gratings; and said photoelectric-cell means comprises a plurality of photoelectric cells spaced at intervals shorter than the length of one of the cylindrical elements and disposed in a plane parallel to the planes of said gratings.

13. A hopper for distributing parts for an automatic machine tool, said parts being in a form of cylindrical elements each having a diameter, said hopper comprising:

means for providing a flow of cylindrical elements;

restraining means downstream from said flow providing means disposed askew a flow of cylindrical elements, said restraining means including a plurality of superimposed gratings comprising rods of circular cross-section and of a diameter equal to the diameter of one of the cylindrical elements, spaced from one another by an interval greater than the diameter of one of the cylindrical elements and less than double the diameter of one of the cylindrical elements, and disposed parallel to the flow of cylindrical elements, each of said gratings being disposed in a plane transverse to the flow of cylindrical elements, said restraining means having a width in a direction parallel to said plane;

actuating means for moving at least one of said gratings with an alternating translatory motion having an amplitude equal to half a said interval in a first direction and half a said interval in a second direction opposite to said first direction; and detection means including photoelectric-cell means and light-source means, disposed in a plane immediately downstream of the plane of a lowermost one of said gratings and capable of detecting an interruption of the flow of the cylindrical elements; and means downstream from said detection means for receiving said flow of elements; wherein:

said restraining means comprises two said gratings, a first one of said gratings being fixed and a second one of said gratings being movable by said actuating means and situated upstream from said first one of said gratings relative to the flow of cylindrical elements; and said photoelectric-cell means comprises a plurality of photoelectric cells spaced at intervals shorter than the length of one of the cylindrical elements and disposed in a plane parallel to the planes of said gratings.

* * * * *